US010364987B2

(12) United States Patent
Hodge

(10) Patent No.: US 10,364,987 B2
(45) Date of Patent: Jul. 30, 2019

(54) WATER AND SCENT RESISTANT SMOKING ACCESSORY

(71) Applicant: AFG Distribution, Inc., Asheville, NC (US)

(72) Inventor: Rick Hodge, Wichita, KS (US)

(73) Assignee: AFG Distribution, Inc., Asheville, NC (US)

( * ) Notice: Subject to any disclaimer, the term of this patent is extended or adjusted under 35 U.S.C. 154(b) by 210 days.

(21) Appl. No.: 15/617,451

(22) Filed: Jun. 8, 2017

(65) Prior Publication Data

US 2017/0356651 A1 Dec. 14, 2017

Related U.S. Application Data

(60) Provisional application No. 62/347,348, filed on Jun. 8, 2016.

(51) Int. Cl.

| | |
|---|---|
| ***F23Q 2/32*** | (2006.01) |
| ***B65D 43/16*** | (2006.01) |
| ***A24F 23/00*** | (2006.01) |
| ***A24F 13/26*** | (2006.01) |
| ***A24F 25/00*** | (2006.01) |
| ***B65D 43/22*** | (2006.01) |
| ***B65D 25/02*** | (2006.01) |

(52) U.S. Cl.

CPC ..... *F23Q 2/32* (2013.01); *A24F 13/26* (2013.01); *A24F 23/00* (2013.01); *A24F 25/00* (2013.01); *B65D 25/02* (2013.01); *B65D 43/163* (2013.01); *B65D 43/22* (2013.01)

(58) Field of Classification Search

CPC ..... A24F 13/18; A24F 13/24; A24F 13/26; A24F 15/18; A24F 19/10; A24F 23/00; A24F 23/04; A24F 25/00; A24F 25/02; A24F 43/16; A24F 43/163; A24F 43/22; B65D 85/10; B65D 25/00; B65D 25/02; B65D 43/16; B65D 43/163; B65D 43/22; F23Q 2/32

USPC ..... 206/38, 38.1, 86, 236, 242–276

See application file for complete search history.

(56) References Cited

U.S. PATENT DOCUMENTS 4,844,254 A * 7/1989 Jang ..... A24F 15/18 206/236
5,277,315 A * 1/1994 Plein ..... A24F 15/18 206/256
5,630,503 A * 5/1997 Rhodes ..... B65D 85/109 206/256
5,832,935 A * 11/1998 Heine ..... A24F 1/00 131/329

(Continued)

OTHER PUBLICATIONS

Specimen of use submitted in U.S. Appl. No. 85/840,431, filed Feb. 4, 2013.

*Primary Examiner* — Bryon P Gehman

(74) *Attorney, Agent, or Firm* — The Van Winkle Law Firm; William G. Heedy

(57) ABSTRACT

A smoking accessory is provided. The accessory includes a chamber for selectively storing a small amount of smoking product. In some embodiments, the chamber is watertight for keeping the product dry. In other embodiments, the chamber is air tight for keeping the product fresh. In still other embodiments, the product includes one or more feature for storing one or more smoking-related product within the accessory for discrete storage and ready access.

14 Claims, 8 Drawing Sheets

(56) References Cited

U.S. PATENT DOCUMENTS

| | | | | |
|---|---|---|---|---|
| 5,934,894 | A * | 8/1999 | Cigler | A24F 13/20 131/249 |
| 6,446,793 | B1 * | 9/2002 | Layshock | A24F 15/18 206/86 |
| 7,815,432 | B2 * | 10/2010 | Smith | F23Q 2/42 206/459.5 |
| 10,028,527 | B2 * | 7/2018 | Jordan | A24F 9/16 |
| 2006/0275726 | A1 * | 12/2006 | Koropsak | F23Q 2/32 431/253 |
| 2007/0000502 | A1 * | 1/2007 | Chong | A24F 13/24 131/249 |
| 2014/0030664 | A1 * | 1/2014 | Maimon | F23Q 2/32 431/253 |

* cited by examiner

WATER AND SCENT RESISTANT SMOKING ACCESSORY

CROSS-REFERENCE TO RELATED APPLICATIONS

This application claims priority pursuant to 35 U.S.C. 119(e) to U.S. Provisional Patent Application Ser. No. 62/347,348, filed Jun. 8, 2016, the entire disclosure of which is incorporated herein by reference.

FIELD OF THE INVENTION

The present invention relates generally to smoking accessories. More specifically, the present invention is concerned with a device having a water and scent resistant chamber.

BACKGROUND OF THE INVENTION

Millions of smokers carry loose tobacco with them on a daily basis or nearly daily basis. Often, this loose tobacco is stored in a bag or a pouch. Although bags and pouches can provide adequate protection for loose tobacco in some circumstances, they are not adequate in all circumstances. For instance, bags and pouches do not always protect tobacco from becoming wet. Furthermore, bags and pouches are flexible and many can be easily ripped or otherwise opened, allowing tobacco to become damaged, allowing tobacco to escape, and/or allowing tobacco to become mixed with unwanted contaminants. Furthermore still, many bags and pouches are not air-tight. As a result, tobacco aromas are allowed to escape, sometimes drawing unwanted attention to the smoker. Consequently, it would be beneficial to have a rigid smoking accessory that includes a water and air resistant chamber for safely and securely storing tobacco.

In some countries, and in some states within this country, smoking other products, such as marijuana, is legal and acceptable. In some circumstances, however, it is desired and/or necessary to maintain some level of discretion regarding the presence of such products and/or paraphernalia for such products. Consequently, it would be beneficial to have a device that is capable of concealing such products and/or paraphernalia so that the presence of such products and/or paraphernalia is virtually unnoticeable and/or undetectable. Furthermore, it would be beneficial to have a product for storing such product and such paraphernalia together for quick and easy access so that a user of such product can quickly and discretely use such product in appropriate places and at appropriate times.

SUMMARY OF THE INVENTION

The present invention comprises a portable smoking accessory for storing a small amount of smoking product, such as tobacco or marijuana. In some embodiments, the accessory includes a rigid body defining a first interior area and a chamber positioned at least partially within the first interior area. The chamber defines a second interior area for holding a small amount of smoking product. In some embodiments, the smoking accessory is portable and is sized and configured to fit within a pocket of a user of the smoking accessory.

The chamber is movable between an open configuration and a closed configuration so as to selectively allow or prevent access to smoking product. The rigid body is similarly moveable between an open configuration and a closed configuration, thereby selectively allowing or preventing access to the chamber. When each of the chamber and the rigid body are in their respective open configurations, a user is able to place product into and/or remove product from the second interior area. Access to the product is prevented or otherwise inhibited when either of the chamber or the rigid body is in its respective closed configurations.

The chamber is air-tight and water-tight when in the closed configuration, thereby protecting the product from loss or damage. In this way, the accessory provides a convenient and discrete means of storing, transporting, and accessing the smoking product. Moving the rigid body to its closed configuration provides additional discretion and protection.

In some embodiments, the accessory further includes one or more feature or accessory associated with use of the smoking product. Referring to FIG. 1, some embodiments include a smoking pipe and a pin. Referring to FIGS. 2, 6B, 8, and 9, some embodiments include a lighter and/or features for receiving and retaining a lighter. Still other embodiments of the accessory include still other features and/or accessory, such as a blade for cutting cigars.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
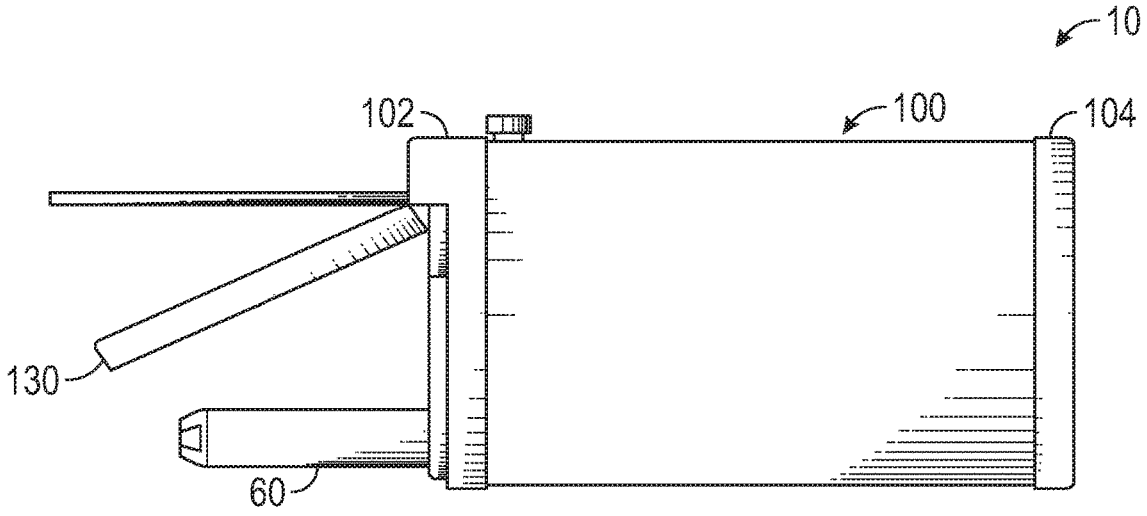
FIG. 1 is a perspective view of an embodiment of a portable smoking accessory, the view showing a first cap in an open configuration, a pin in an extended position, and a pipe partially inserted into a pipe chamber.
Figure 2:
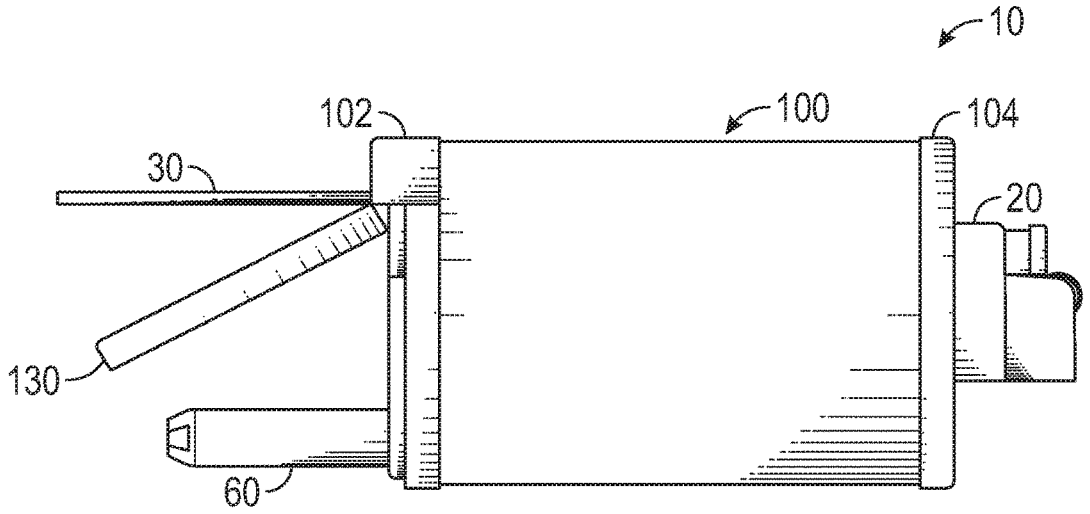
FIG. 2 is a side view of an embodiment of a portable smoking accessory, the view showing a first cap in an open configuration, a pin in an extended position, a pipe partially inserted into a pipe chamber, and a lighter being received and retained by a second opening of a rigid body of the present invention.
Figure 5:
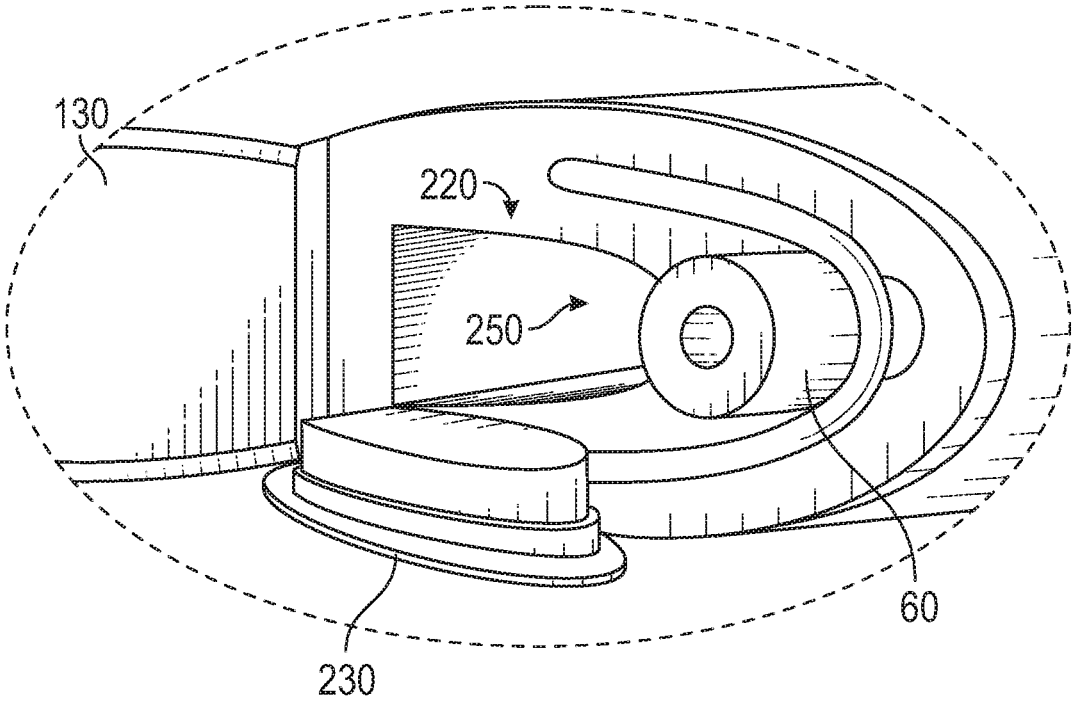
FIG. 5 is a partial view of an embodiment of the present invention showing a second cap in an open configuration and a pipe extending partially from a pipe chamber.
Figure 9:
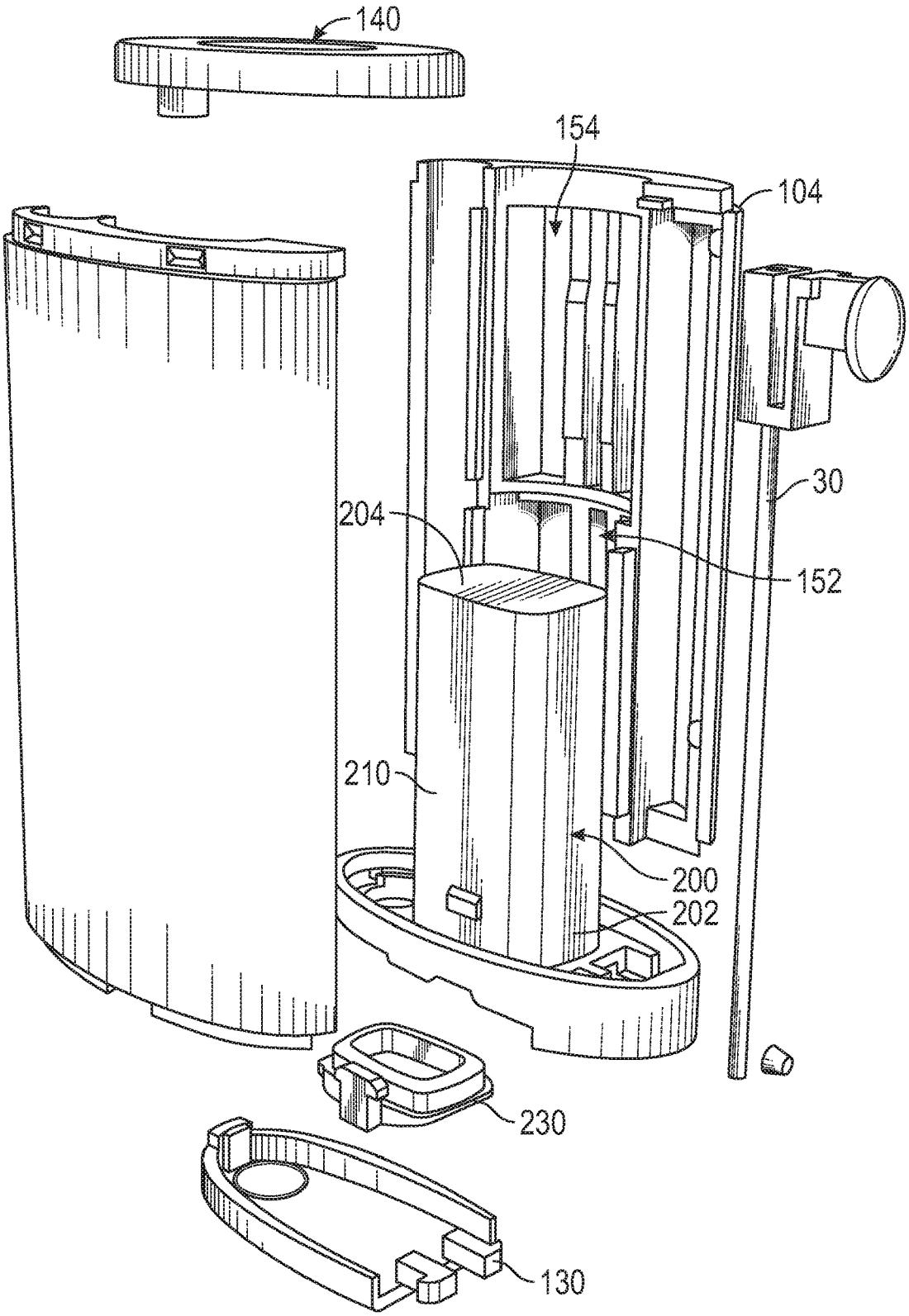
FIG. 9 is an exploded view of the embodiment of FIG. 6A.

Referring to FIGS. 1, 5, and 9, the present invention comprises a portable smoking accessory 10 for storing a small amount of smoking product, such as tobacco or marijuana. In some embodiments, the accessory 10 comprises a rigid body 100 having an exterior wall 110 extending between opposed first 102 and second 104 ends of the rigid body 100 so as to define a first interior area 150. In some such embodiments, a chamber 200 is positioned at least partially within the first interior area 150. In some embodiments, the chamber 200 includes a continuous wall 210 extending between opposed first 202 and second 204 ends of the chamber 200 so as to define a second interior area 250. In some such embodiments, the second interior area 250 is defined at least partially by a portion of the chamber 200 that extends into the first interior area 150. In other such embodiments, the second interior area 250 is entirely defined by portions of the chamber 200 that extends into the first interior area 150.

Figure 10:
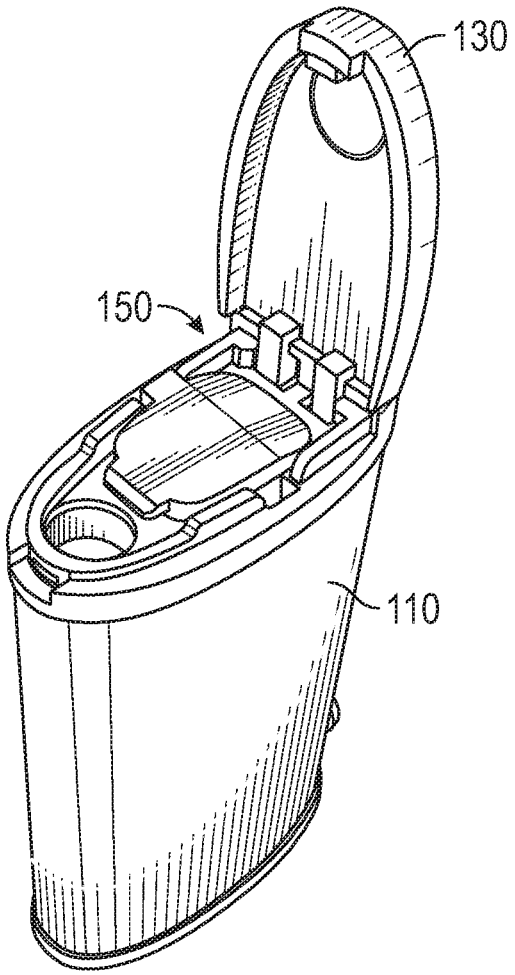
FIG. 10 is a perspective view of the embodiment of FIG. 6A showing a rigid body in an open configuration and a product chamber in a closed configuration.
Figure 11:
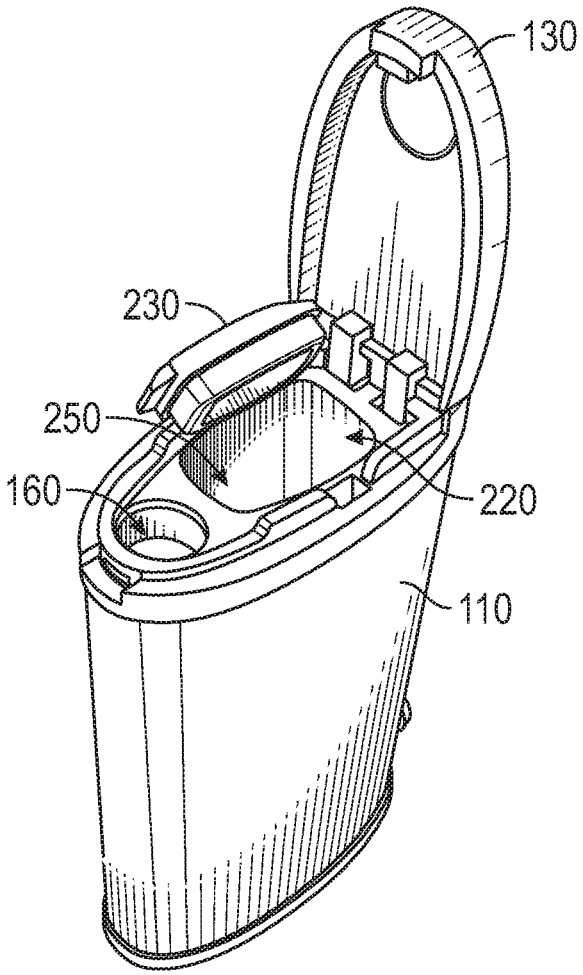
FIG. 11 is a perspective view of the embodiment of FIG. 6A showing a rigid body in an open configuration and a product chamber in an open configuration.

In preferred embodiments, the chamber 200 is moveable between an open configuration (Ref. FIG. 11) and a closed configuration (Ref. FIG. 10). In the open configuration, a user of the smoking accessory 10 is able to place smoking product into the chamber 200 and/or remove smoking product from the chamber 200. In the closed configuration, the chamber 200 is configured to retain smoking product within the second interior area 250. In some embodiments, the chamber 200 is watertight so as to keep the smoking product dry. In other embodiments, the chamber 200 is airtight so as to keep the smoking product fresh and/or so as to reduce and/or eliminate the chance that any aromas associated with smoking product in the chamber 200 will be detectable outside of the chamber 200 when the chamber 200 is in the closed configuration.

Figure 3:
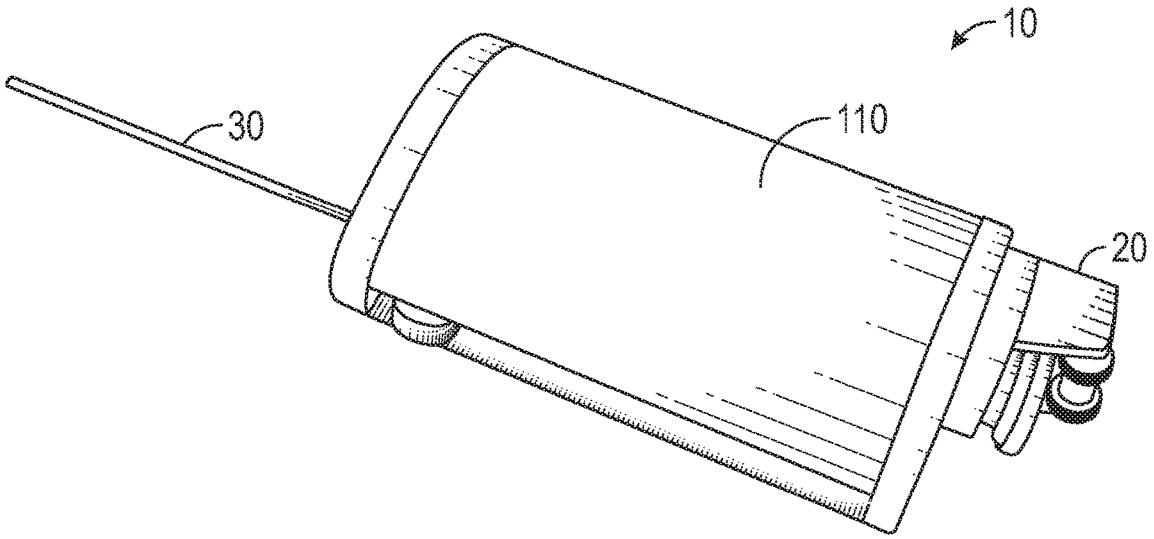
FIG. 3 is an isometric view of a portable smoking accessory, the view showing a pin in an extended position and a lighter being received and retained by a second opening of a rigid body of the present invention.
Figure 4:
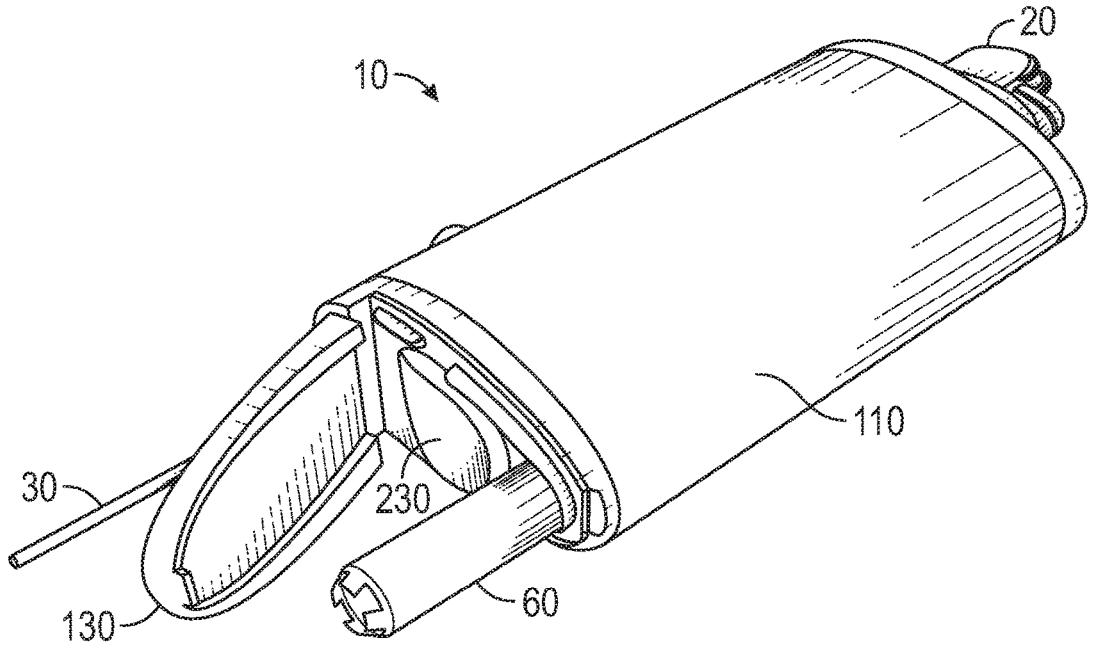
FIG. 4 is an isometric view of an embodiment of the present invention showing a first cap in an open configuration, a second cap in a closed configuration, a pipe partially inserted into a pipe chamber, a pin in an extended position, and a lighter being received and retained by a second opening of a rigid body of the present invention.

In some embodiments, the rigid body 100 is moveable between an open configuration (Ref. FIG. 4) and a closed configuration (Ref. FIG. 3). In some such embodiments, the rigid body 100 is configured to allow access to the chamber 200 when the rigid body 100 is in the open configuration. In other such embodiments, the rigid body 100 is configured to inhibit or even prevent access to the chamber 200 when the rigid body 100 is in the closed configuration. In preferred embodiments, the smoking accessory 10 is configured such that when the rigid body 100 and the chamber 200 are each in their respective closed configurations, the chamber 200 is prevented from moving to its open configuration. In this way, the rigid body 100 provides an additional level of protection for the smoking product by decreasing the chances that the chamber 200 will inadvertently be moved to the open configuration.

In preferred embodiments, the first end 102 of the rigid body 100 defines a first opening 120 when the rigid body 100 is in the open configuration. In some such embodiments, the first opening 120 is in communication with the first interior area 150 and is configured so as to allow items to pass through the first opening 120 and into the first interior area 150. In other such embodiments, the first opening 120 covers all or substantially all of the first end 102 of the rigid body 100.

In some embodiments, the rigid body includes a first cap 130 that is moveable between an engaged configuration and a disengaged configuration. In the engaged configuration, the first cap 130 is configured to selectively couple to the first end 102 of the rigid body 100. In some such embodiments, the first cap 130 fills all or substantially all of the first opening 120 such that items within the first interior area 150 are prevented from exiting the first interior area 150 through the first opening 120, thereby causing the rigid body 100 to be in the closed configuration. In other such embodiments, the first cap 130 is hingedly coupled to the first end 102 of the rigid body 100 so as to allow the first cap 130 to rotate away from the engaged configuration to the disengaged configuration. In some such embodiments, moving the first cap 130 from the engaged configuration to the disengaged configuration causes the rigid body 100 to move from the closed configuration to the open configuration.

In preferred embodiments, the first end 102 of the rigid body 100 and the first cap 130 each include corresponding snap-lock features. In some such embodiments, the corresponding snap-lock features are configured to allow the first cap 130 to be received by the first opening 120 so as to allow the rigid body 100 to move from the open configuration to the closed configuration by pressing the first cap 130 into the first opening 120. In other such embodiments, the corresponding snap-lock features are configured to engage with each other when the first cap 130 is in the engaged configuration, thereby moving the first cap 130 to a locked configuration in which the first cap 130 is retained in the engaged configuration. In still other such embodiments, the snap-lock features are configured so as to allow a user of the smoking accessory 10 to disengage the snap-lock features from each other, thereby moving the first cap 130 to an unlocked configuration so as to enable the first cap 130 to be moved away from the engaged configuration.

Figure 6A:
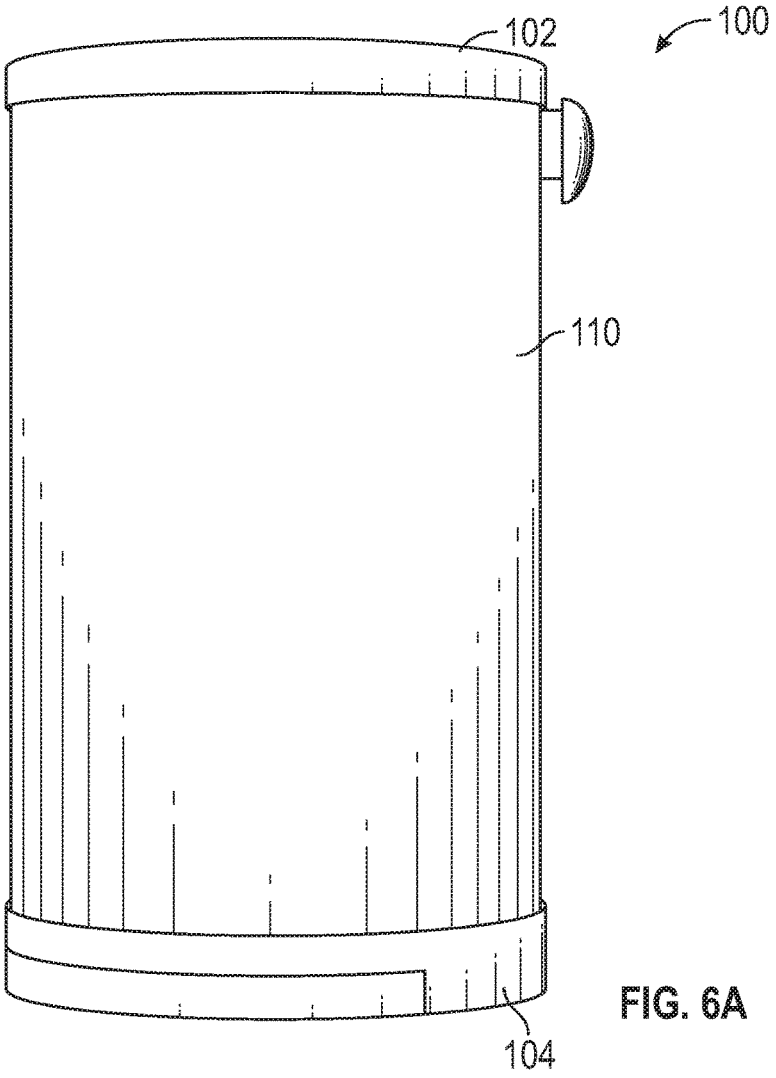
FIG. 6A is a front view of an embodiment of the present invention.
Figure 6B:
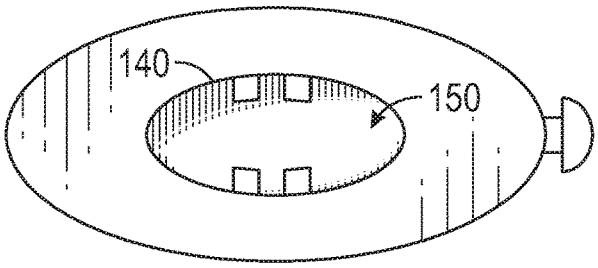
FIG. 6B is a top view of the embodiment of FIG. 6A.
Figure 6C:
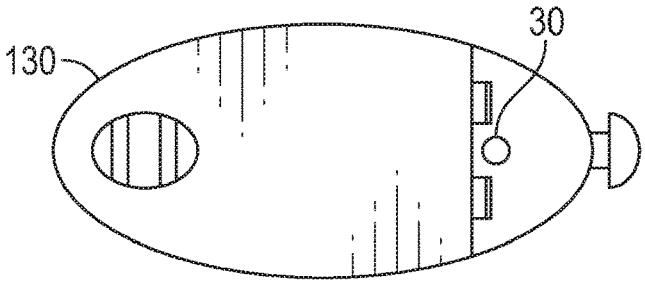
FIG. 6C is a bottom view of the embodiment of FIG. 6A.
Figure 7C:
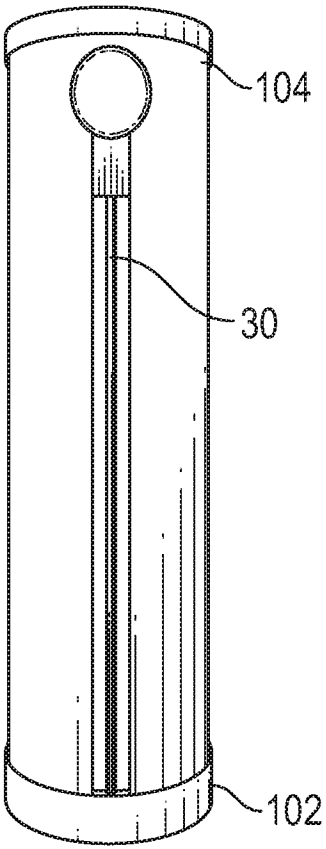
FIG. 7C is a second side view of the embodiment of FIG. 6A.
Figure 7B:
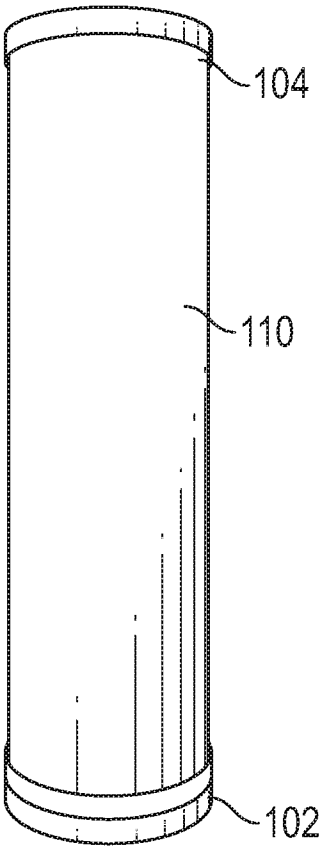
FIG. 7B is a first side view of the embodiment of FIG. 6A.
Figure 7A:
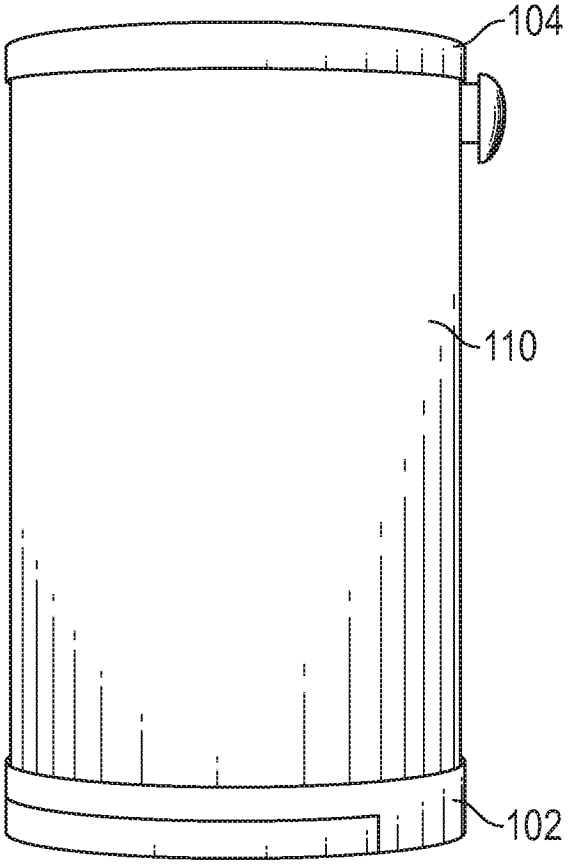
FIG. 7A is a rear view of the embodiment of FIG. 6A.
Figure 8:
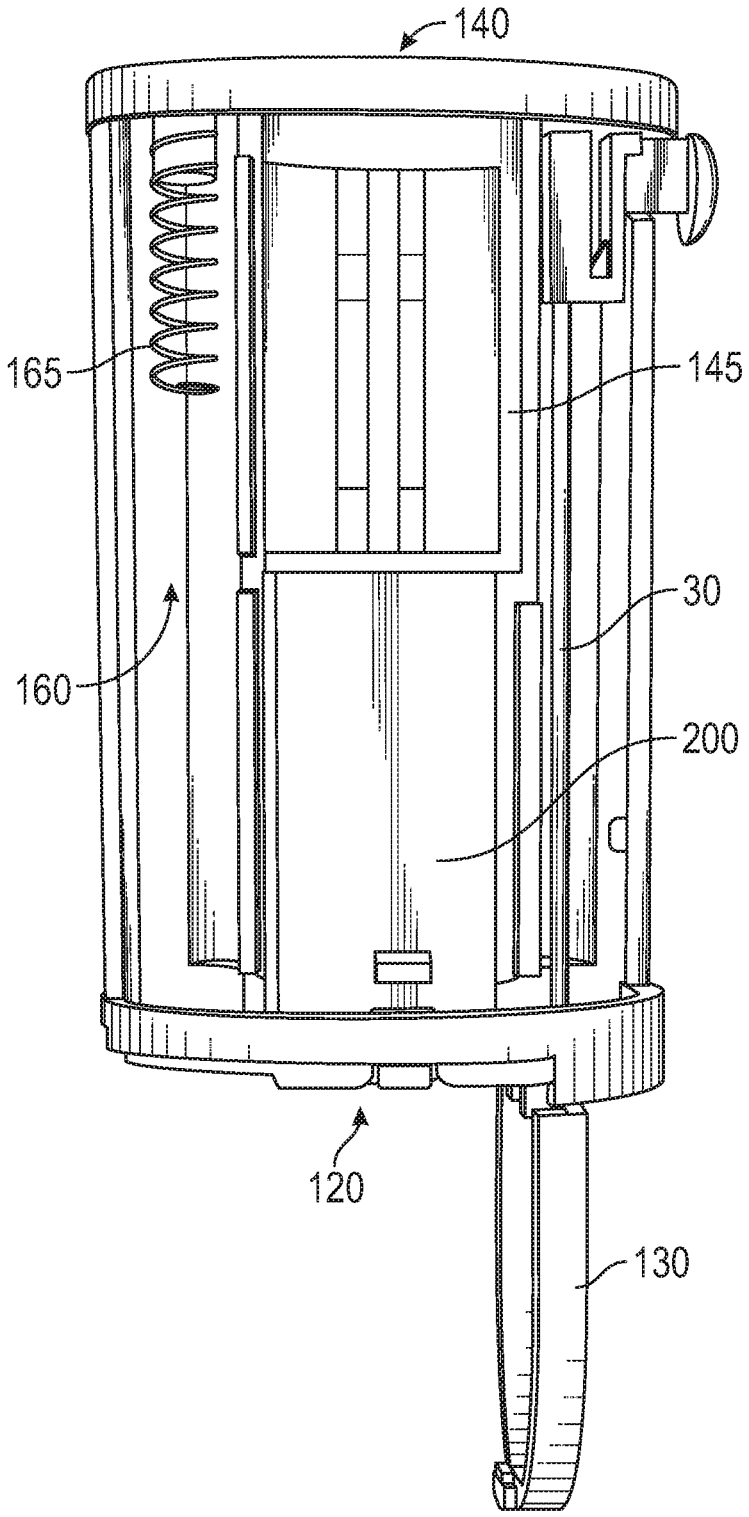
FIG. 8 is an internal view of the embodiment of FIG. 6A.

In some embodiments, the rigid body 100 is configured to receive and/or hold at least part of an item, such as a lighter 20 (Ref. FIGS. 3, 6B, and 8). In some such embodiments, the second end 104 of the rigid body defines a second opening 140 for receiving a bottom end of a lighter 20. In some embodiments, the second opening 140 is in communication with at least a portion of the first interior area 150. In this way, the second end 104 is configured to allow the lighter 20 to be inserted through the second opening 140 so as to be at least partially inserted into the first interior area 150. In some such embodiments, the rigid body 100 is further configured to retain the lighter 20 in the second opening 140, thereby retaining the lighter 20 in close proximity to the product chamber 200. In other such embodiments, a shell 145 extends from the second opening 140 into the first interior area 150. In some such embodiments, as shown in FIGS. 8 and 9, the shell 145 divides the first interior area 150 into first 152 and second 154 portions, with the second portion 154 being in communication with the second opening 140 and the first portion 142 being separated from the second opening 140 by the shell 145. In some such embodiments, the shell 145 prevents items and fluids, such as water and/or air, from passing into and/or out of the first portion 152 of the first interior area 150.

In some embodiments, the first end 202 of the chamber 200 defines a chamber opening 220 when the chamber 200 is in the open configuration. In some such embodiments, the chamber opening 220 is in communication with the second interior area 250 and is configured so as to allow items to pass through the chamber opening 220 and into the second interior area 240. In other such embodiments, the chamber opening 220 covers all or substantially all of the first end 202 of the chamber 200.

In some embodiments, the chamber 200 includes a chamber cap 230 that is moveable between an engaged configuration and a disengaged configuration. In the engaged configuration, the chamber cap 230 is configured to selectively couple to the first end 202 of the chamber. In some such embodiments, the chamber cap 230 fills all or substantially all of the chamber opening 220 such that product within the second interior area 220 is prevented from exiting the second interior area 220 through the chamber opening 250, thereby causing the chamber to be in the closed configuration. In other such embodiments, the chamber cap 230 is hingedly coupled to the first end 202 of the chamber 200 so as to allow the chamber cap 230 to rotate away from the engaged configuration to the disengaged configuration. In some such embodiments, moving the chamber cap 230 from the engaged configuration to the disengaged configuration causes the chamber 200 to move from the closed configuration to the open configuration.

In preferred embodiments, the first end 202 of the chamber 200 and the chamber cap 230 each include corresponding snap-lock features. In some such embodiments, the corresponding snap-lock features are configured to allow the chamber cap 230 to be received by the chamber opening 220 so as to allow the chamber 200 to move from the open configuration to the closed configuration by pressing the chamber cap 230 into the chamber opening 200. In other such embodiments, the corresponding snap-lock features are configured to engage with each other when the chamber cap 230 is in the engaged configuration, thereby moving the chamber cap 230 to a locked configuration in which the chamber cap 230 is retained in the engaged configuration. In still other such embodiments, the snap-lock features are configured so as to allow a user of the smoking accessory 10 to disengage the snap-lock features from each other, thereby moving the chamber cap 230 to an unlocked configuration so as to enable the chamber cap 230 to be moved away from the engaged configuration.

In some embodiments, the accessory 10 further includes at least one of a blade (not shown) or other means of cutting a cigar and a lighter or other means of lighting an item, such as a cigarette, a cigar, a pipe, or the like. In some such embodiments, the lighter extends at least partially from the rigid container. In other such embodiments, the lighter includes a cartridge for holding a combustible fluid, such as lighter fluid, and a means of igniting the combustible fluid. In still other such embodiments, the lighter includes a removable cartridge. In yet other such embodiments, the lighter includes a refillable cartridge. In some embodiments, a lighter cartridge of the present invention is positioned at least partially within the first interior area 150 of the rigid body 100. In other embodiments, the smoking accessory 10 is configured to selectively receive and retain a bottom portion of a lighter.

In some embodiments, the smoking accessory 10 includes one or more item associated with smoking. In some such embodiments, the item is a pin 30 that is sized and configured so as to assist a smoker in cleaning a pipe or other item commonly used for smoking. In some embodiments, the pin 30 is a retractable pin that is slidably connected to the rigid body 100. In some such embodiments, the pin 30 is moveable between a retracted position and an extended position. In some such embodiments, the pin 30 is positioned at least partially within the first interior area 150 when the pin 30 is in the retracted position, thereby retaining the pin 30 in general proximity to the chamber 200. In other such embodiments, the pin 30 extends at least partially from the rigid body 100 when the pin 30 is in the extended position, thereby allowing the pin 30 to be used as a cleaning device.

In some embodiments of the present invention, the rigid body 100 defines a pipe chamber 160. In some such embodiments, the pipe chamber 160 is positioned at least partially within the first interior area 150. In other such embodiments, the pipe chamber 160 is configured to selectively receive a smoking pipe 60 so as to enable the smoking pipe 60 to be stored within the smoking accessory 10 and/or in general proximity to the chamber 200. In still other such embodiments, the pipe chamber 160 is configured to selectively receive a smoking pipe 60 so as to enable the smoking pipe 60 to be moved to a fully stowed position. In some such embodiments, the smoking pipe 60 is completely concealed within the pipe chamber 160 when the smoking pipe 60 is in the fully stowed position and the rigid body 100 is in the closed configuration.

Some embodiments of the present invention further include a biasing member 165. In some embodiments, the biasing member 165 is configured to bias the smoking pipe 60 away from the fully stowed position. In some such embodiments, the biasing member 165 is configured to completely expel the smoking pipe 60 from the pipe chamber 160. In other such embodiments, the biasing member 165 is configured to bias the smoking pipe 60 towards a partially stowed position. In some embodiments, the smoking pipe 60 is partially received by the pipe chamber 165 when the smoking pipe 60 is in the partially stowed position. In other embodiments, a first end of the smoking pipe 60 extends from the smoking accessory when the smoking pipe 60 is in the partially stowed configuration so as to enable a user of the portable smoking accessory 10 to grasp the first end of the smoking pipe 60 and remove the smoking pipe 60 from the portable smoking accessory 10.

In some embodiments, the biasing member 165 is positioned at least partially within the pipe chamber 160. In other embodiments, the biasing member 165 is a spring. In still other embodiments, the first cap 130 is configured to move the smoking pipe 60 from the partially stowed position to the fully stowed position when the first cap 130 is moved from the disengaged configuration to the engaged configuration. In still other embodiments, the first cap 130 is configured to retain the smoking pipe 60 in the fully stowed position when the first cap 130 is in the locked configuration. In still other embodiments, the biasing member 165 is configured to move the smoking pipe 60 from the fully stowed position to the partially stowed position when the first cap 130 is moved from the engaged configuration to the disengaged configuration.

In some embodiments of the present invention, the chamber 200 is configured to receive a second end of a smoking pipe 60 when the chamber is in the open configuration. In this way, the present invention enables a user of the portable smoking accessory to at least partially fill the second end of the smoking pipe 60 with smoking product stored within the chamber 200, thereby accommodating discrete movement of small amount of smoking product from an item that is configured to accommodate the storage of the product to an item that is configured to accommodate the smoking of the product.

The present invention further includes a method of storing a small amount of smoking product for future use. The method includes placing the smoking product into an interior area 250 of a chamber 200 of a portable smoking accessory 10 of the present invention by passing the smoking product through a chamber opening 220 defined by the chamber 200. The method further includes moving the chamber 200 from an open configuration to a closed configuration, such as by moving a chamber cap 230 into selective engagement with the chamber opening 220. In some embodiments, the chamber itself is air tight and water tight in the closed configuration so that the smoking product is protected, preserved, and undetectable.

In some embodiments, the method of storing a small amount of smoking product further includes moving a rigid body 100 of the portable smoking accessory 10 from an open configuration to a closed configuration. In this way, the chamber 200 is concealed within an interior area 150 of the rigid body 100 and the chamber 200 is prevented from, or otherwise inhibited from, moving away from its closed configuration.

The present invention further includes a method of discretely extracting a small amount of smoking product from a smoking accessory. The method includes moving a chamber 200 of the portable smoking accessory 10 from a closed configuration to an open configuration, thereby allowing a small amount of smoking product to move out of an interior area 250 of the chamber 200 through a chamber opening 220 defined by the chamber 200. In some embodiments, the method further includes inserting a first end of a smoking pipe 60 through the chamber opening 220 so as to engage with smoking product in the interior area 250. In this way, the smoking pipe is capable of extracting the smoking product so that the smoking product can be quickly and easily lit and smoked.

In some embodiments, the method of discretely extracting a small amount of smoking product from the smoking accessory further includes moving a rigid body 100 of the smoking accessory 10 from a closed configuration to an open configuration, thereby allowing a user to remove the smoking pipe 60 from a pipe chamber 160 defined by the rigid body 100. In some such embodiments, the chamber 200 is positioned within the rigid body 100 adjacent to the pipe chamber 160. In this way, the smoking product and the means of smoking the product are each capable of being retained discretely within the smoking accessory until they are each discretely removed from the smoking accessory.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A portable smoking accessory comprising:

a rigid body including a first end and an opposed second end and a rigid exterior wall extending between said first and second ends so as to define a first interior area;

a product chamber including a first end and an opposed second end and a continuous wall extending between said first and second ends so as to define a second interior area for holding smoking product, said product chamber being positioned at least partially within said first interior area of said rigid body, said first end of said product chamber defines an opening; and a second cap that is configured to selectively couple to said first end of said product chamber, wherein said rigid body is configured to fit within a pocket of a user of the portable smoking accessory, wherein said product chamber is moveable between a closed configuration, wherein said second cap is coupled to said first end of said product chamber, and an open configuration, wherein said second cap is uncoupled from said first end of said product chamber, wherein said product chamber is configured to retain the smoking product within said second interior area when said product chamber is in the closed configuration, wherein said product chamber is configured to allow access to the smoking product when said product chamber is in the open configuration, thereby allowing the user of the portable smoking accessory to extract smoking product from said second interior area, and wherein said second end of said rigid body defines a second opening for receiving a bottom end of a lighter to allow the lighter to be inserted at least partially into said first interior area, thereby retaining the lighter in close proximity to the product chamber.

2. The portable smoking accessory of claim 1, wherein said first end and said opposed second end and said continuous wall extending between said first end and said second end of said product chamber define a watertight barrier between said second interior area and said first interior area when said product chamber is in the closed configuration, thereby keeping the smoking product dry.

3. The portable smoking accessory of claim 1, wherein said opposed first and second ends and said continuous wall extending between said first and second ends of said product chamber define a airtight barrier between said second interior area and said first interior area when said product chamber is in the closed configuration, thereby keeping the smoking product fresh.

4. The portable smoking accessory of claim 1, wherein said rigid body is moveable between an open configuration and a closed configuration, wherein said rigid body is configured to allow access to said product chamber when said rigid body is in the open configuration, and wherein said rigid body is configured to inhibit access to said product chamber when said rigid body is in the closed configuration.

5. The portable smoking accessory of claim 4, wherein said first end of said rigid body defines a first opening when said rigid body is in the open configuration, said rigid body further comprising a first cap that is configured to selectively couple to said first end of said rigid body when said rigid body is in the closed configuration.

6. The portable smoking accessory of claim 5, wherein said first end of said rigid body and said first cap comprise corresponding snap-lock features for accommodating snapping the first cap to the rigid body when moving the rigid body from the open configuration to the closed configuration, thereby retaining the rigid body in the closed configuration.

7. The portable smoking accessory of claim 1, further comprising a continuous wall extending from said second opening into said first interior area, thereby dividing said first interior area into a first portion and a second portion, said second portion being in communication with said second opening.

8. The portable smoking accessory of claim 1, wherein said first end of said product chamber and said second cap comprise corresponding snap-lock features for accommodating snapping the second cap to the product chamber when moving the product chamber from the open configuration to the closed configuration, thereby retaining the product chamber in the closed configuration.

9. The portable smoking accessory of claim 1, further comprising a lighter extending at least partially from said rigid container, the lighter having a refillable cartridge for holding a combustible fluid, said refillable cartridge of the lighter being positioned at least partially within said first interior area of said rigid body.

10. The portable smoking accessory of claim 1, wherein said rigid body is configured to selectively receive a bottom portion of a lighter so as to securely retain the lighter in general proximity to said product chamber.

11. The portable smoking accessory of claim 1, further comprising a retractable pin coupled to said rigid body, said retractable pin being selectively moveable between a retracted position and an extended position, wherein said retractable pin is positioned within said first interior area when said retractable pin is in the retracted position, thereby retaining said retractable pin in general proximity to said product chamber, and wherein said retractable pin extends from said rigid body when said retractable pin is in the extended position, thereby allowing said retractable pin to be used as a cleaning device.

12. The portable smoking accessory of claim 1, wherein said rigid body defines a pipe chamber within said first interior area, said pipe chamber being configured to selectively receive a smoking pipe so as to enable the smoking pipe to be moved to a fully stowed position wherein the smoking pipe is entirely concealed by the smoking accessory.

13. The portable smoking accessory of claim 12, further comprising a biasing member positioned at least partially within said pipe chamber, said biasing member being configured to bias the smoking pipe towards a partially stowed position, thereby enabling a user of the portable smoking accessory to grasp a first end of the smoking pipe so as to facilitate removal of the smoking pipe from the portable smoking accessory.

14. The portable smoking accessory of claim 12, wherein said product chamber is configured to receive a second end of the smoking pipe when the smoking pipe is removed from said pipe chamber, thereby enabling a user of the portable smoking accessory to at least partially fill the second end of the smoking pipe with smoking product from the product chamber.

* * * * *